US007651168B2

(12) United States Patent
Kelly

(10) Patent No.: US 7,651,168 B2
(45) Date of Patent: Jan. 26, 2010

(54) ADJUSTABLE CHILD SUPPORT DEVICE

(75) Inventor: Brian S. Kelly, East Aurora, NY (US)

(73) Assignee: Mattel, Inc., El Segundo, CA (US)

( * ) Notice: Subject to any disclaimer, the term of this patent is extended or adjusted under 35 U.S.C. 154(b) by 336 days.

(21) Appl. No.: 11/681,234

(22) Filed: Mar. 2, 2007

(65) Prior Publication Data

US 2007/0205639 A1 Sep. 6, 2007

Related U.S. Application Data

(60) Provisional application No. 60/778,373, filed on Mar. 3, 2006.

(51) Int. Cl.
*A47D 13/00* (2006.01)

(52) U.S. Cl. ..... 297/467; 297/153; 297/423.19

(58) Field of Classification Search ..... 297/423.19, 297/467, 153, 149
See application file for complete search history.

(56) References Cited

U.S. PATENT DOCUMENTS

| | | | |
|---|---|---|---|
| 146,888 | A | 1/1874 | Downing |
| 257,873 | A | 5/1882 | Klein |
| 595,450 | A | 12/1897 | Archer |
| 1,334,771 | A | 3/1920 | McClary |
| 1,341,192 | A | 5/1920 | Oppenheim |
| 1,506,629 | A | 8/1924 | Giffin |
| 1,556,622 | A | 10/1925 | Meharey |
| 1,587,253 | A | 6/1926 | Tarbox |
| 1,967,096 | A | 7/1934 | McCoy |
| 2,409,622 | A | 10/1946 | Gottfried |
| D148,187 | S | 12/1947 | Renaud |
| D156,697 | S | 1/1950 | Buehler et al. |
| 2,495,843 | A | 1/1950 | Glenn |
| 2,503,942 | A | 4/1950 | Engelberg et al. |
| 2,516,801 | A | 7/1950 | Renaud |
| 2,895,537 | A | 7/1959 | Davidson |
| 3,071,410 | A | 1/1963 | Gaskins |
| 3,294,440 | A | 12/1966 | Broder |
| 3,425,743 | A | 2/1969 | Peterson |
| 3,425,744 | A | 2/1969 | Spector et al. |
| 3,578,381 | A | 5/1971 | Young |
| 3,649,074 | A | 3/1972 | McDonald et al. |

(Continued)

FOREIGN PATENT DOCUMENTS

| | | | |
|---|---|---|---|
| DE | 10125242 | A1 | 3/2002 |

(Continued)

*Primary Examiner*—Anthony D Barfield
(74) *Attorney, Agent, or Firm*—Edell, Shapiro & Finnan, LLC

(57) ABSTRACT

A child support device including adjustable features is disclosed. The support device may be a high chair including an adjustable foot support and/or tray portion. The child support device may include a base, a frame attached to the base, and a seat attached to the frame. The seat may include a primary restraint such as a crotch post. The footrest may be telescopically connected to the primary restraint such that its position relative to the seat may be altered. The tray, moreover, may include a secondary restraint that cooperates with the primary restraint to provide an additional safety feature. The tray and the secondary restraint may be repositioned with respect to the primary restraint to accommodate children of various sizes.

19 Claims, 10 Drawing Sheets

U.S. PATENT DOCUMENTS

| | | | | |
|---|---|---|---|---|
| 3,913,976 | A | | 10/1975 | Plancher et al. |
| 4,095,843 | A | | 6/1978 | Hirsch |
| 4,160,553 | A | | 7/1979 | Fleischer |
| 4,234,152 | A | | 11/1980 | Browse |
| 4,603,902 | A | | 8/1986 | Maloney |
| 4,615,560 | A | | 10/1986 | Schaller |
| D287,196 | S | | 12/1986 | Ryder-Smith |
| 4,722,570 | A | | 2/1988 | Bertoli |
| 4,938,603 | A | | 7/1990 | Turner et al. |
| 4,958,885 | A | | 9/1990 | Kassai |
| D330,637 | S | | 11/1992 | Takahashi et al. |
| 5,203,613 | A | | 4/1993 | Ward |
| 5,238,292 | A | | 8/1993 | Golenz et al. |
| 5,332,241 | A | | 7/1994 | Rho |
| 5,346,279 | A | | 9/1994 | Pecorella |
| 5,348,374 | A | | 9/1994 | Kuo |
| 5,445,432 | A | | 8/1995 | Chien |
| 5,468,051 | A | | 11/1995 | Huang |
| 5,480,210 | A | | 1/1996 | Lehenbauer et al. |
| 5,489,138 | A | | 2/1996 | Mariol et al. |
| 5,505,519 | A | | 4/1996 | Natt |
| 5,507,550 | A | | 4/1996 | Maloney |
| 5,509,719 | A | | 4/1996 | Cone, II |
| 5,520,433 | A | | 5/1996 | Tokutake et al. |
| 5,527,096 | A | | 6/1996 | Shimer |
| 5,547,256 | A | | 8/1996 | D'Antuono et al. |
| 5,551,656 | A | | 9/1996 | DeLozada et al. |
| 5,558,400 | A | | 9/1996 | Poulson et al. |
| 5,669,664 | A | | 9/1997 | Perego |
| 5,782,532 | A | | 7/1998 | Opsvik |
| 5,820,207 | A | | 10/1998 | Wang |
| 5,839,706 | A | | 11/1998 | Liu |
| 5,931,534 | A | | 8/1999 | Hutter |
| 5,951,102 | A | | 9/1999 | Poulson et al. |
| 6,024,412 | A | * | 2/2000 | Kain et al. ..... 297/467 X |
| 6,050,643 | A | | 4/2000 | Kain et al. |
| 6,126,236 | A | | 10/2000 | Wu |
| 6,161,898 | A | | 12/2000 | Brevi |
| D439,061 | S | | 3/2001 | Donaldson |
| 6,293,623 | B1 | | 9/2001 | Kain et al. |
| 6,345,864 | B1 | | 2/2002 | Rivera et al. |
| 6,347,833 | B1 | | 2/2002 | Chen |
| 6,439,515 | B1 | | 8/2002 | Powers |
| 6,474,735 | B1 | | 11/2002 | Carnahan et al. |
| 6,511,123 | B1 | | 1/2003 | Sitarski et al. |
| D483,958 | S | | 12/2003 | Chen |
| 6,666,505 | B2 | | 12/2003 | Greger et al. |
| 6,676,212 | B1 | | 1/2004 | Amirault |
| 6,715,827 | B1 | | 4/2004 | Chen |
| D493,624 | S | | 8/2004 | Chen |
| 6,851,752 | B2 | | 2/2005 | Asbach |
| 2003/0015903 | A1 | | 1/2003 | Myers |
| 2003/0067193 | A1 | | 4/2003 | Asbach et al. |
| 2003/0102702 | A1 | | 6/2003 | Daley et al. |
| 2003/0151285 | A1 | | 8/2003 | Keegan et al. |
| 2003/0218366 | A1 | | 11/2003 | Rho |
| 2004/0026976 | A1 | * | 2/2004 | Chen et al. ..... 297/344.14 X |
| 2004/0256896 | A1 | | 12/2004 | Myers |
| 2005/0029852 | A1 | | 2/2005 | Chen |
| 2005/0127722 | A1 | | 6/2005 | Longenecker et al. |

FOREIGN PATENT DOCUMENTS

| | | | |
|---|---|---|---|
| GB | 2139881 | A | 11/1984 |
| GB | 2358793 | A | 8/2001 |

* cited by examiner

ADJUSTABLE CHILD SUPPORT DEVICE

CROSS REFERENCE TO RELATED APPLICATIONS

This application claims priority under 35 U.S.C. §119(e) to U.S. Provisional Application No. 60/778,373, filed 03 Mar. 2006 and entitled "Adjustable Child Support Device", the disclosure of which is hereby incorporated by reference in it entirety.

FIELD OF THE INVENTION

The present invention relates generally to a child support device and, in particular, to a highly adjustable high chair

BACKGROUND OF THE INVENTION

Support devices such as high chairs support young children during feeding and other activities. High chairs are used by children throughout a relatively large age span. As such, the wide range of physical development that a child undergoes during that age span presents challenges to designing a high chair that accommodates all of the physical needs of the child growing. Conventional high chairs have a single size or configuration, and therefore, they sometimes do not comfortably fit children of various sizes. As a result, parents often need to purchase multiple support structures to accommodate their children as they grow or to accommodate children of different age groups. Consequently, a need exists for a support device that can be adjusted to fit children of different sizes.

SUMMARY OF THE INVENTION

Accordingly, the present invention is directed toward a support structure for a child including adjustable portions and, particularly, to a high chair including an adjustable footrest and/or tray assembly. A high chair in accordance with the present invention may include a base, a frame coupled to the base, and a seat coupled to the frame. The seat may include a primary restraint such as a crotch post. The footrest may be configured to telescope into and out of the primary restraint such that its position relative to the seat may be altered. The tray assembly, moreover, may comprise a secondary restraint configured to cooperate with the primary restraint such that the secondary restraint may be repositioned with respect to the primary restraint and accommodate children of various sizes.

BRIEF DESCRIPTION OF THE DRAWINGS

Like reference numerals have been used to identify like elements throughout this disclosure.

DETAILED DESCRIPTION OF THE INVENTION

Figure 1:
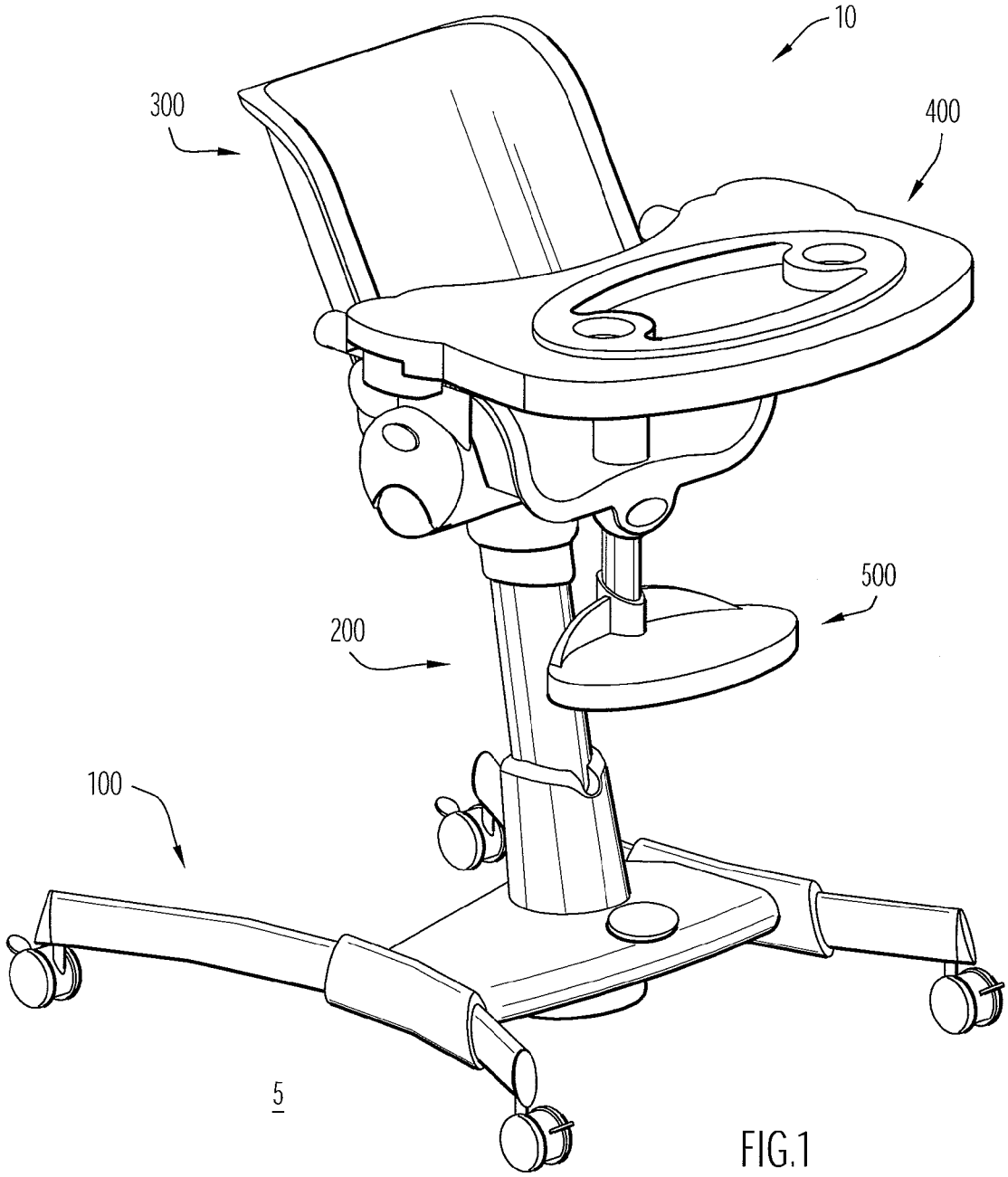
FIG. 1 illustrates a perspective view of a child support device according to an embodiment of the present invention.

FIG. 1 is a perspective view of the child support device according to an embodiment of the present invention. As shown, the child support device may include a high chair 10 with a base 100, a frame 200, and a seat 300. The high chair 10 may further include a tray assembly 400, as well as a foot support or footrest assembly 500 coupled to the seat 300.

Figure 2:
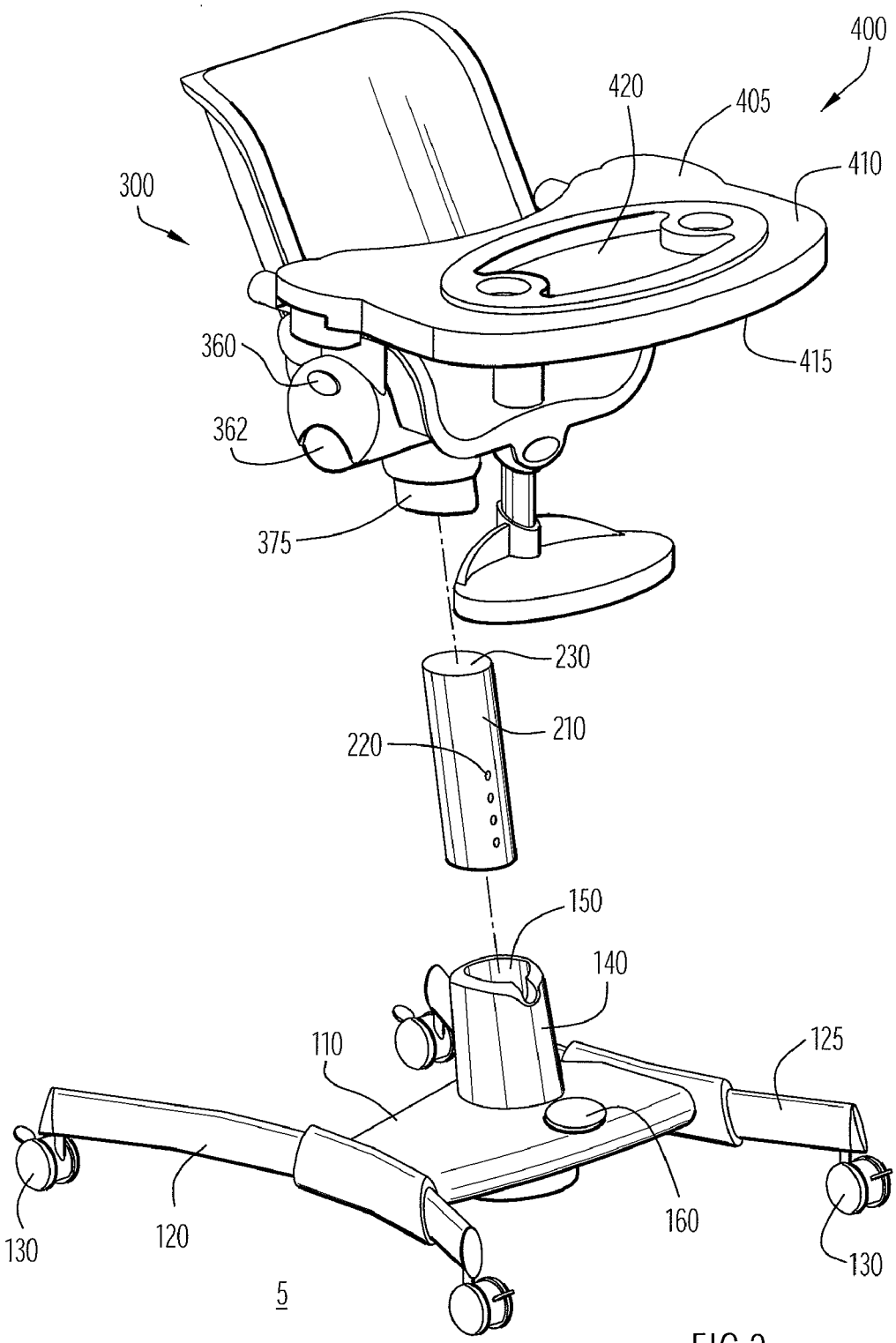
FIG. 2 illustrates an exploded view of the child support device of FIG. 1.

The base 100 includes a structure configured to support the frame 200 and the seat 300 above a supporting surface 5. FIG. 2 is an exploded view of the child support device 10 of FIG. 1. As shown, the base 100 may comprise a central portion or housing 110 with a first rail 120 and a second rail 125 disposed along the respective left and right sides of the housing 110. Each rail 120, 125 may have an arcuate shape, e.g., bowing outward (away from the base). Other rail shapes, however, may be utilized. Casters 130 may be connected to each of the first and second rails 120, 125 (e.g., proximate the rail ends) to enable the rolling of the high chair 10 along the supporting surface 5. The type of caster 130 which is compatible with the present invention includes, but is not limited to, single and double wheeled casters including a locking mechanism operable to prevent the rolling of the wheels and secure the high chair 10 in a stationary position with respect to the supporting surface 5. A collar 140 extends upward from the top surface of the housing 110, proximate its center. The shape of the collar 140 may include, but is not limited to, a generally annular shape. The collar 140 defines a channel 150 configured to slidingly receive the frame 200.

The frame 200 includes a structure configured to support the seat 300 above the base 100 (and thus, above the supporting surface 5). In the embodiment illustrated in FIG. 2, the frame 200 comprises a pedestal or tube 210 extending upward from the base 100 to the seat 300. The tube 210 may have a generally cylindrical shape that slidingly engages the channel 150 of the collar 140, with the exterior surface of tube 210 contoured to complement the interior surface of the channel 150 of the collar 140. The exterior surface 230 of the tube 210 is received with a recess formed into a hub 375 located on the bottom of the seat 300 (discussed in greater detail below). Alternatively, the end of the tube 210 may be configured with an internal recess configured to receive a projection portion of the hub 375 (not illustrated).

In accordance with the present invention, the high chair 10 may also include a height adjustment mechanism configured to adjust the length of the frame 200 relative to the base 100, moving the seat 300 from a first vertical position to a second vertical position, and vice versa. For example, the tube 210 may comprise a series of vertically aligned notches or slots 220. The base 100, moreover, may include a resilient tab (not shown) configured to selectively engage the slots 220. The housing 110 of the base 100 may include an actuator or pedal 160 in communication with the resilient tab that mates with each of the slots 220 in the tube 210 of the frame 200. The pedal 160 may be spring biased such that, when the pedal 160 is in its normal position, the resilient tab engages a slot 220 (i.e., the tab extends into the channel 150 and into alignment with a slot 220 in the tube 210 of the frame 200). This immobilizes the tube 210, preventing its axial movement within the channel 150, securing the seat 300 at a desired vertical height. When the pedal 160 is engaged, the resilient tab is drawn out of the slot 220; consequently, the tab no longer impedes the axial movement of the tube 210 within the channel 150. There is no limit to where on the base 100 the pedal 160 may be situated; as shown in FIG. 2, the pedal 160 may be located along the front of the base.

With this configuration, by engaging the pedal 160, a user may easily adjust the height of the seat 300. In operation, a user engages (e.g., depresses) the pedal 160, moving the resilient tab from its normal, biased position, in which it is positioned within a first slot 220 in the tube 210 of the frame 200, to its retracted position in which the tab disengages the first slot 220. Once removed, the user is free to move the tube 210 (vertically) with respect to the base 100. Specifically, a user may axially insert the tube 210 into (to shorten the height with respect to the base 200) or remove the tube 210 out of (the increase the height) the channel 150 of the collar 140 until the desired seat height is achieved. When the pedal 160 is released, the spring urges the resilient tab toward a second slot 220 and, when aligned, into the slot 220. The resilient tab is received by the second slot 220, securing the high chair 10 at the new vertical position.

Figure 3:
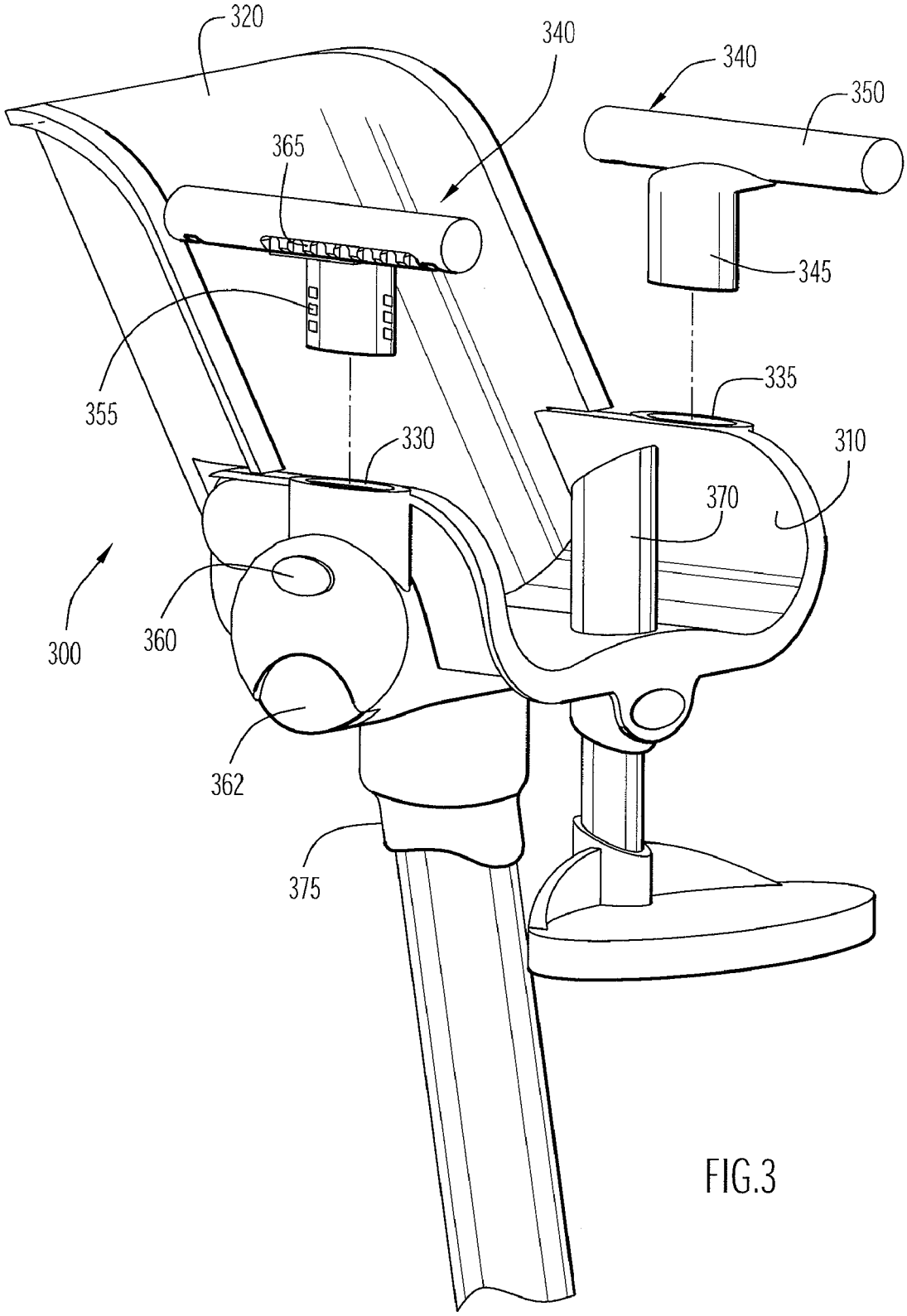
FIG. 3 illustrates a close-up view of the seat of the child support device shown in FIG. 1, with the tray removed and the armrests disconnected for clarity.

The seat 300, coupled to the top end of the tube 210, comprises a structure that receives and supports a child. Referring to FIG. 3, the seat 300 may include a seat base 310 (also called a seat portion) and a seat back 320 (also called a back portion). The seat base 310 and the seat back 320 may comprise a single piece, or may comprise individual sections. The seat back 320, moreover, may be adapted to pivot with respect to the seat base 310 to adjust the angle of inclination of the seat back, permitting a child to recline in the seat 300. The seat 300 may further include straps or belts (not illustrated) operable to secure a child when seated therein. For example, the seat 300 may include a child restrain mechanism similar to that described in U.S. patent application Ser. No. 11/678,888, the disclosure of which is hereby incorporated by reference in its entirety.

The seat base 310 may further include a first armrest receptacle 330 and a second armrest receptacle 335 positioned at opposite sides of the seat base 310. Each receptacle 330, 335 is configured to receive an armrest 340. The shape of the armrest 340 is not limited to that which is illustrated herein. As shown in the embodiment of FIG. 3, each of the armrests 340 may include a generally T-shaped structure including a vertical portion or post 345 and a horizontal portion or arm pad 350. The post 345 of each armrest 340 is inserted into its associated receptacle 330, 335. Preferably, the armrests 340 are adapted to be repositioned within the receptacles 330, 335 such that the height of the arm pad 350 with respect to the seat 310 base may be vertically adjusted. That is, the post 345 of each armrest 340 may be contoured to slidably engage its associated receptacle 330, 335, permitting its axial movement into and out of the receptacle 330, 335.

The seat 300 further includes a locking mechanism to secure the armrests 340 at a desired vertical height. In the embodiment illustrated in FIG. 3, each armrest post 345 includes opposed, corrugated indents 355 disposed along its peripheral edges. The seat base 310, moreover, includes a spring-biased actuator 360 that controls prongs (not shown) configured to mate with the indents 355 on the post 345. When the actuator 360 is oriented in its normal (outwardly biased) position, the prongs are positioned within the indents 355. Depressing the actuator 360 retracts the prongs from the indents 355, permitting the axial movement of the post 345 within the receptacle 330, 335. When the actuator 360 is released, the actuator returns to its normal position (as a result of the spring bias), with the each prong again engaging its corresponding indent 355.

With this configuration, the height of each arm pad 350 (i.e., the depth at which the post 345 extends into a receptacle 330, 335) may be altered. In operation, the armrests 340 begin at a first height. A user depresses the actuator 360, causing the prongs to retract from a first pair of indents 355. Once retracted, the armrest 340 becomes axially moveable within a receptacle 330, 335; consequently, the armrest 340 may be repositioned from the first vertical height to a second vertical height. Once repositioned, the actuator 360 is released to secure the armrest 340 at the second vertical height. Since the tray assembly 400 couples to the armrests 340 (discussed in greater detail below), with this configuration, the vertical position of the tray assembly 400 with respect to the seat base 310 may be adjusted by repositioning each armrest 340 to corresponding vertical positions.

The seat base 310 may further comprise a primary restraint 370 extending from its surface. As shown in the embodiment illustrated in FIG. 3, the primary restraint 370 comprises a post (e.g., a crotch post) extending upward from the top surface of the seat base 310. The shape of the primary restraint 370 may include, but is not limited to, a generally cylindrical post. The primary restraint 370 may include an internal channel (referenced as 372 in FIGS. 8 and 9) comprising dimensions sufficient to receive the support member of the footrest assembly 500 as described below.

The seat base 310 connects to the frame 200 via a connection hub 375. The hub 375 extends downward from the bottom of the seat base 310, proximate the center of the base. The hub 375 slidingly engages the seat base 310, allowing the seat 300 to be rotated with respect to the frame 200. By way of example, the hub 375 may comprise a generally cylindrical boss that slidingly engages the tube 210 (or vice versa). Consequently, a user may rotate the seat 300 to orient a child in multiple directions (i.e., the child may face in any direction). The degree of rotation of the seat 300 may include, but is not limited to, 360° of rotation. The hub 375 may further include a series of annularly spaced notches (not illustrated). The notches are configured to engage a protrusion controlled by a hub actuator 362 located on the seat base 310 (e.g., below the armrest adjustment actuator 360). The protrusion (and thus the actuator 362) is spring biased in a deployed, hub-engaging position. Engaging (e.g., pulling) the actuator 362 retracts the protrusion, permitting the hub 375 to rotate within or about the tube 210 and pivoting the seat 300 with respect to the frame 200.

With this configuration, the seat base 310 may be repositioned from a first seat-facing position to a second seat facing position by engaging the actuator 362 to retract the protrusion from a first hub notch, rotating the seat 300 from the first position to the second position, and then releasing the actuator so that the spring drives the protrusion toward the hub 375 and into a second hub notch.

Figure 4:
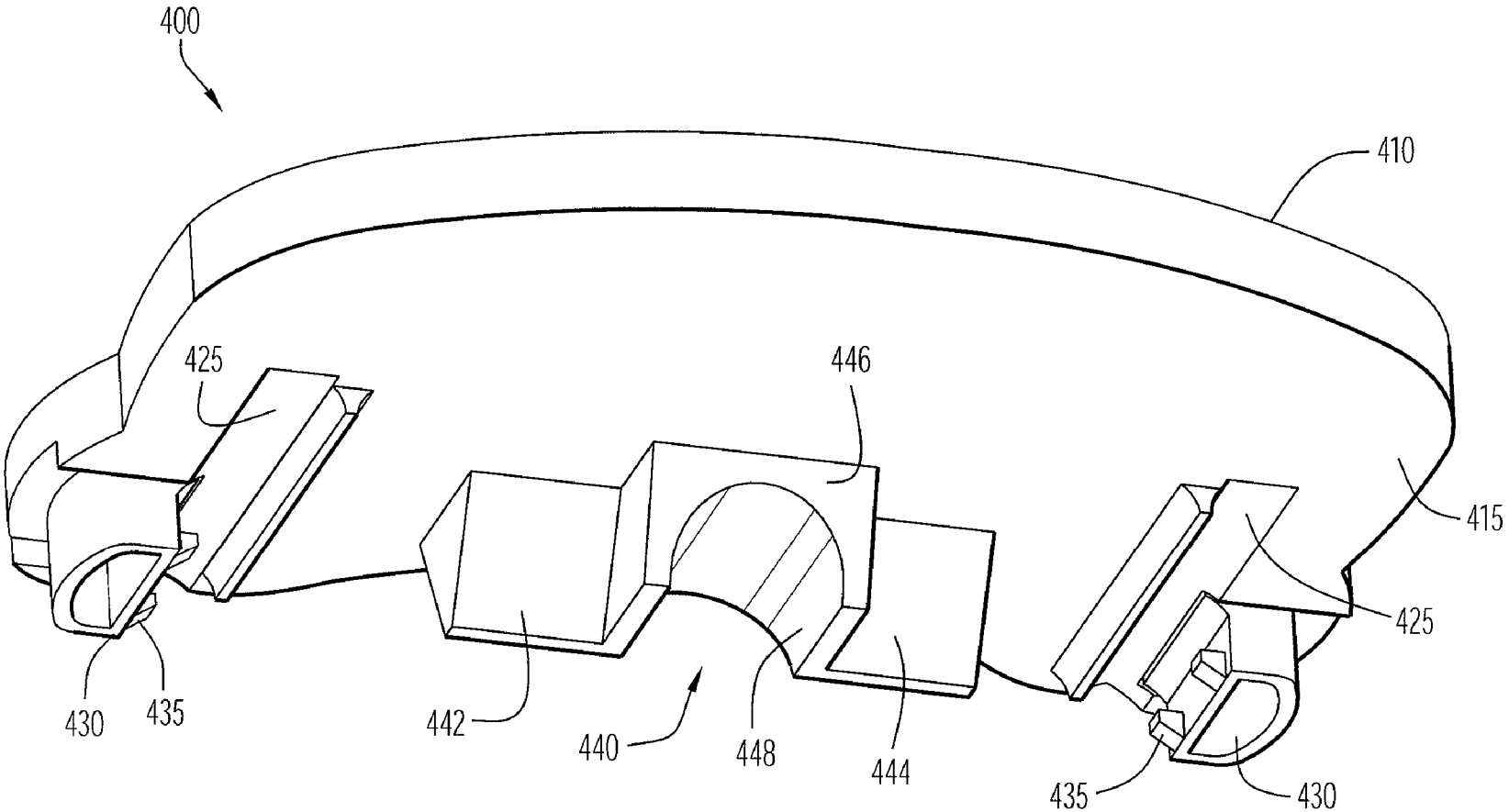
FIGS. 4 and 5 illustrate front and side perspective views of the underside of the tray assembly of the child support device of FIG. 1 in isolation.
Figure 5:
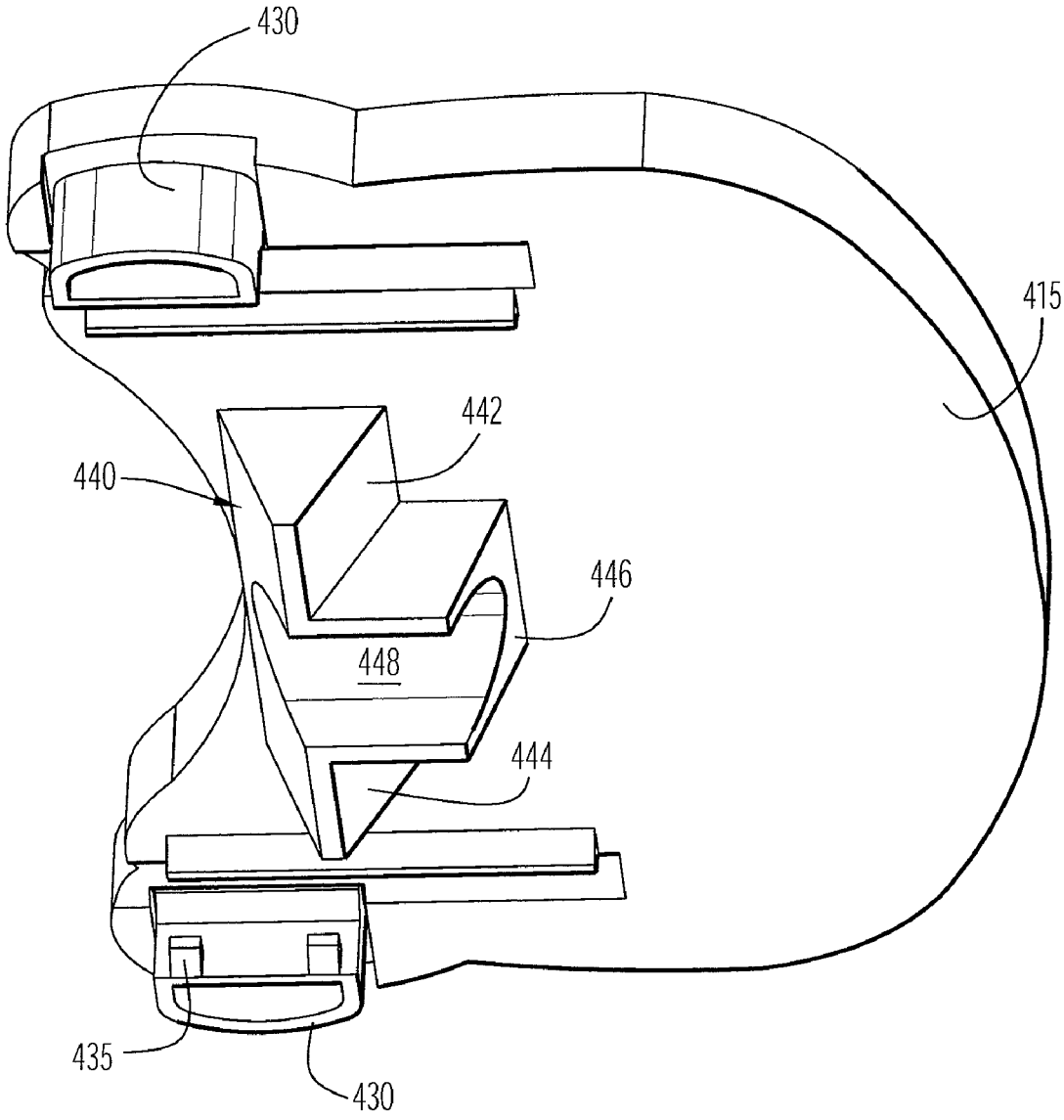

As referenced above, the tray assembly 400 is connected to the high chair 10 via the armrests 340. The tray assembly 400 may include a tray 405 with a first or upper surface 410 and a second or lower surface 415. The first or upper surface 410 of the tray 405 may include a central portion adapted to receive a removable, dishwasher-safe tray liner 420. FIGS. 4 and 5 illustrate front and side perspective views of the underside of the tray assembly 400 of FIG. 1 in accordance with an embodiment of the present invention. As shown, the lower surface 415 of the tray assembly 400 includes a pair of tracks 425 contoured to the shape of the arm pads 350. In addition, a pair of opposed grips or latches 430 extend from the lower surface 415 of the tray assembly 400. Each latch 430 is aligned with a corresponding armrest 340 on the high chair. Each latch 430, moreover, includes teeth 435 configured to mate with the indents 365 located on each arm pad 350 (FIG. 3). The latches 430 are spring biased toward the arm pads 350 such that, when in their normal position, the teeth 435 are positioned within the indents 365, securing the tray assembly 400 to the armrests 340.

In addition, tray assembly 400 may be repositioned along the armrests 340. Specifically, each latch 430 is movable relative to the tray 405 between a latched position, in which each latch 430 engages its respective armrest 340, and an unlatched position, in which each latch 430 disengages its respective armrest 340. In the disengaged position, the tray assembly 400 may be repositioned with respect to the seat 300 by sliding the tray along the tracks 425. In operation, they tray assembly 400 begins in a first tray position, with each latch 430 engaging its respective armrest 340. The latches 430 are pulled away from the armrest 340 so the teeth 435 disengage their corresponding indents 365. Once disengaged, the user is then free to slide the tray assembly 400 along the armrests 340, from the first tray position to a second tray position. At this point, the latches 430 are released, allowing the spring (not shown) to return the latches 430 to their normal position (i.e., the teeth 435 mate with corresponding indents 365). This, in turn, secures the tray assembly 400 in the second position. Accordingly, the tray assembly 400 can be adjusted quickly and easily toward and away from the seated child by engaging the latches 430 and moving the tray assembly 400 to a desired position with respect to the seat 300. Alternatively, the tray assembly 400 may be removed from the armrests 340 altogether by utilizing the latches 430 to disengage the indents 365 and separating the armrests 340 from the tracks 425.

The second or lower surface 415 of the tray assembly 400 may be contoured to interact with the primary restraint extending from the seat base 310. For example, the lower surface 415 may be contoured to interact with the primary restraint 370. This contouring may form a secondary restraint that at least partially surrounds the primary restraint to not only limit the movement of the primary restraint 370, but also to at least partially block the passages existing between the tray assembly 400 and the seat portion 300 (e.g., on either sides of the primary restraint 370). In operation, the secondary restraint is operable to permit the repositioning of the tray assembly 400 with respect to the seat 300, while preventing a child's escape/exit from the seat 300.

Referring again to FIGS. 4 and 5, the secondary restraint 440 may take the form of an extension including a first end 442, a second end 444, and an intermediate portion 446 positioned between the first and second ends. The intermediate 446 portion is arched such that a generally arcuate passage 448 is formed. The arcuate passage 448 defines an open channel with dimensions sufficient to permit the primary restraint 370 to pass therethrough. That is, the arcuate passage 448 of the secondary restraint 440 is adapted to mate with the primary restraint 370 such that the secondary restraint 440 permits movement of the tray assembly 400 toward and away from the seated child without interference from the primary restraint 370.

Figure 6:
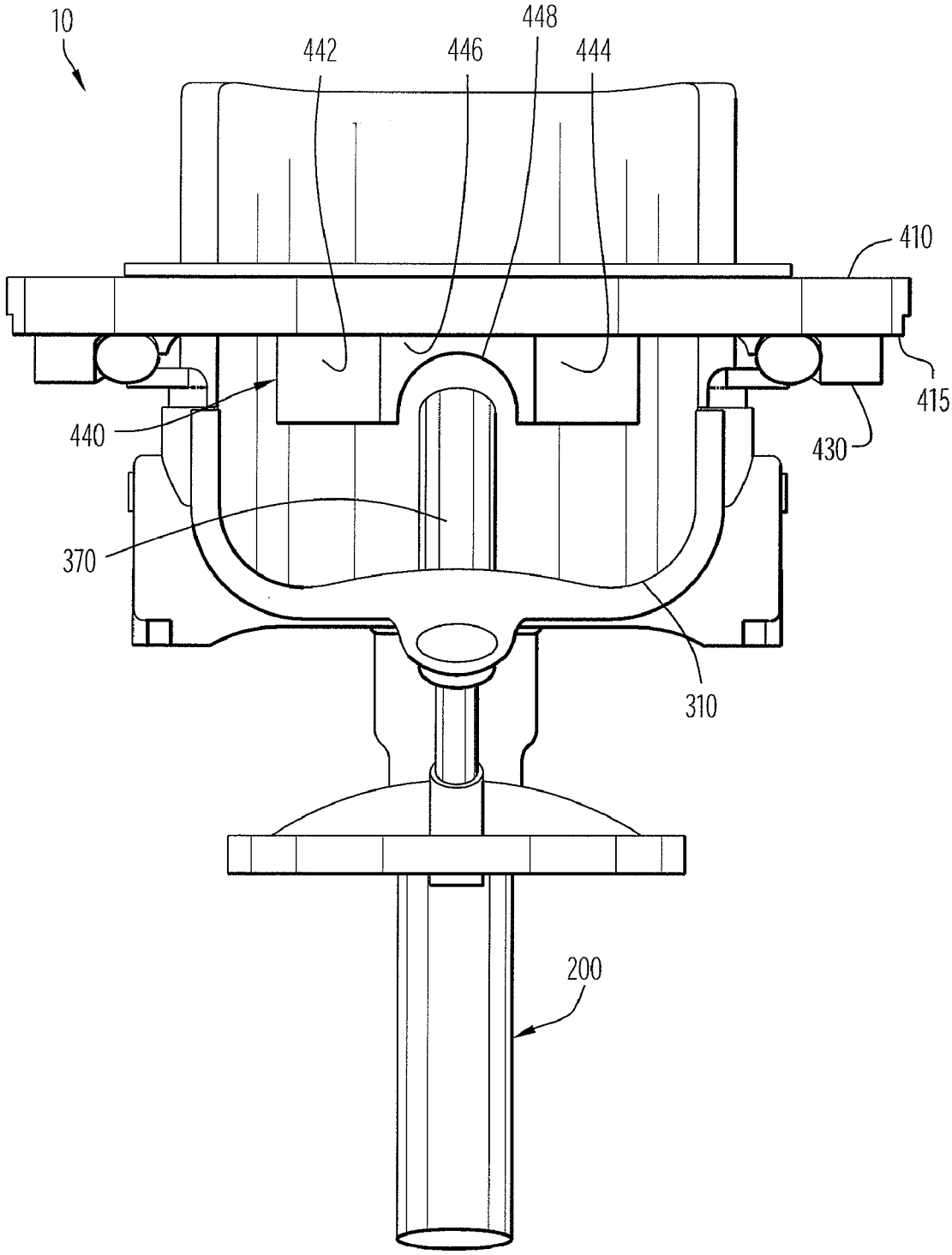
FIG. 6 illustrates a front, close-up view of the child support shown in FIG. 1.

FIG. 6 illustrates a close up front view of the high chair 10 of FIG. 1, showing the interaction between the primary 370 and secondary 440 restraints. As shown, the primary restraint 370 is separated from the surface of the arcuate passage 448 of the secondary restraint 440 by a gap that permits the movement of the secondary restraint 440 over the primary restraint 370, toward and away from the seated child. The secondary restraint 440 includes dimensions sufficient to meet current safety standards which prevent a child from "submarining" (sliding downward between the tray assembly 400 and the seat base 310 and becoming entrapped there between).

Figure 7A:
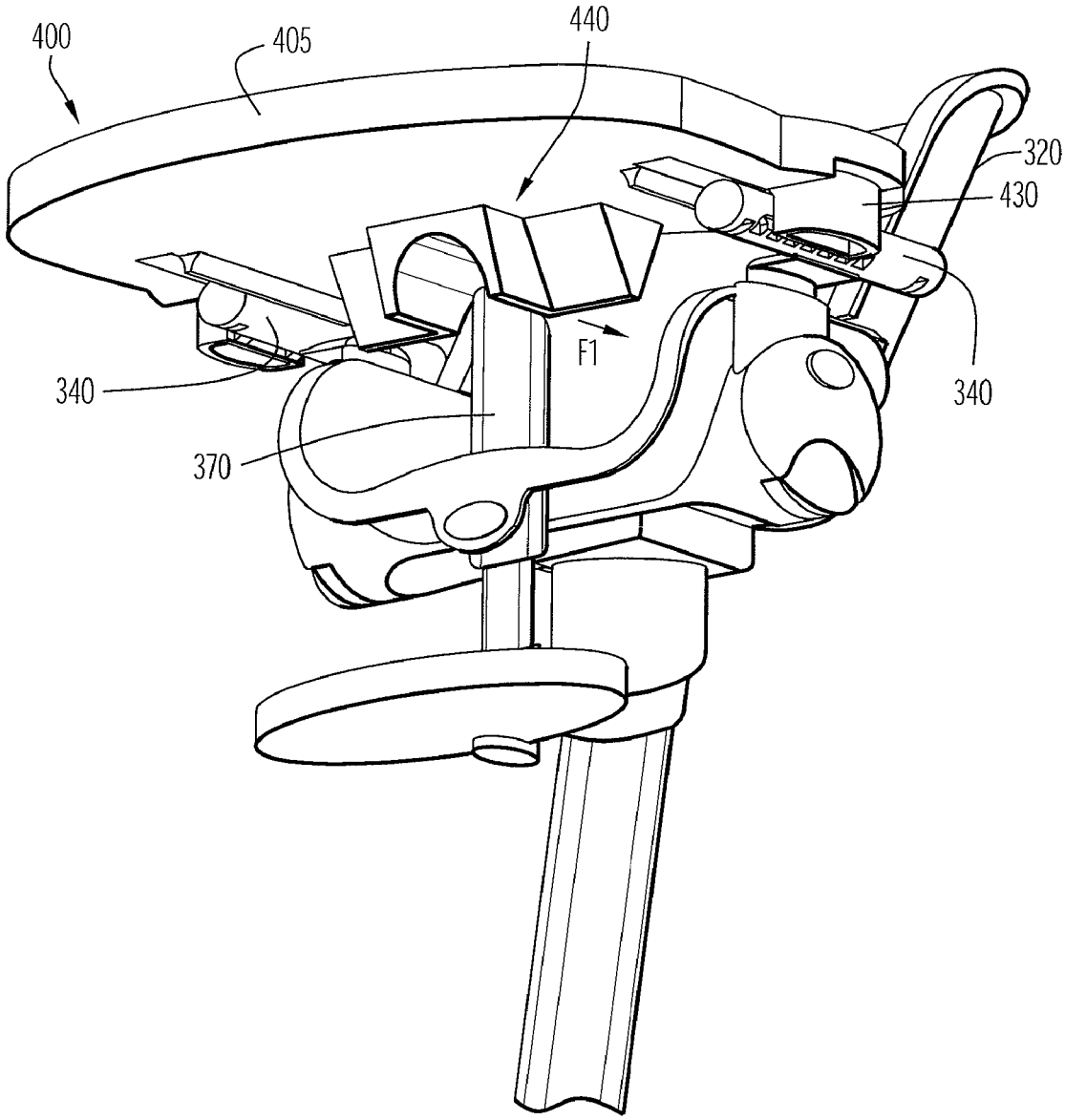
FIGS. 7A and 7B illustrate perspective, close-up views of the child support shown in FIG. 1, showing the tray assembly moving from a first position in FIG. 7A to a second position in FIG. 7B.
Figure 7B:
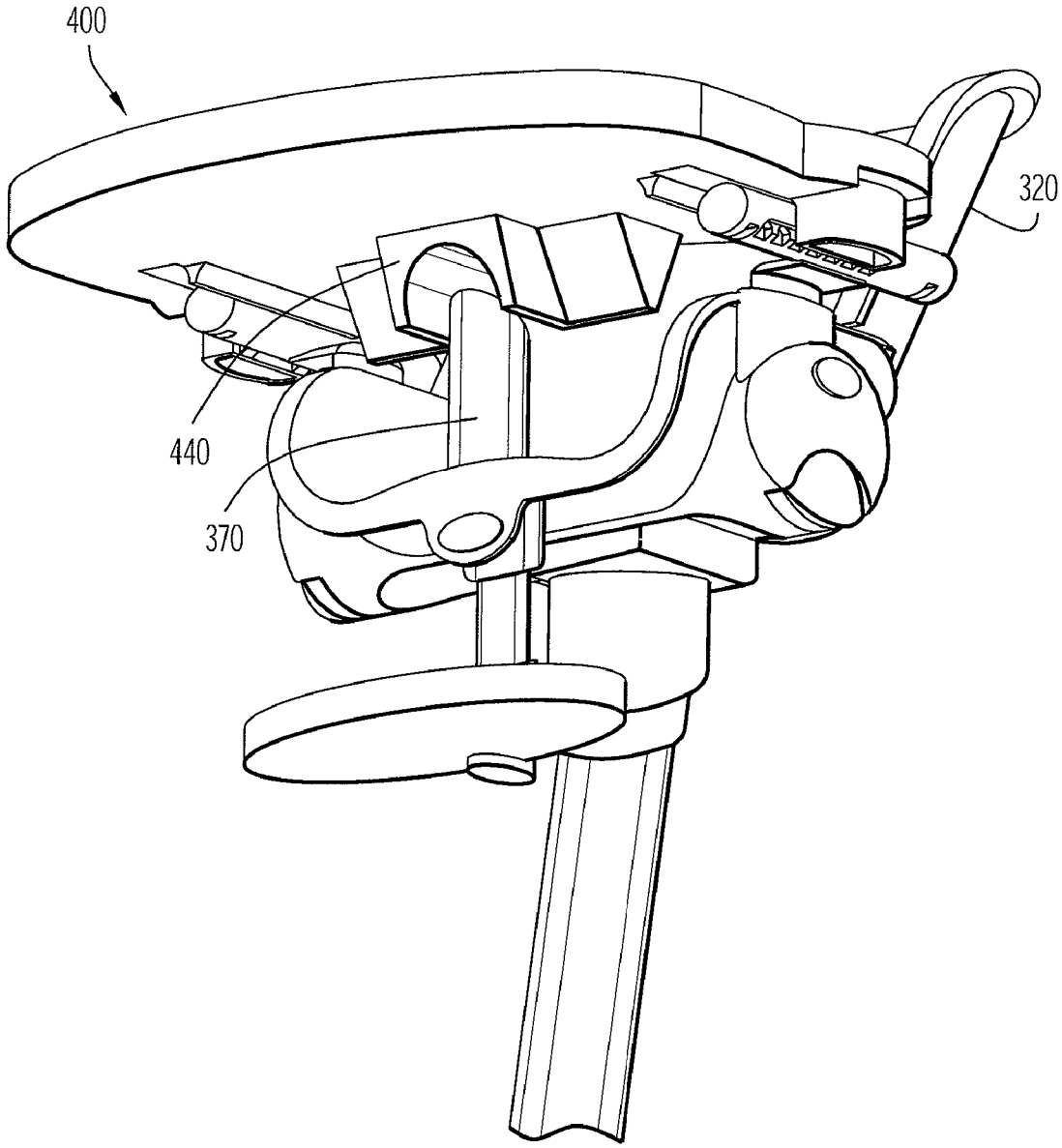

FIGS. 7A and 7B are side views of the seat 300 and tray assembly 400 shown in FIG. 6, showing the tray assembly 400 being moved from a first position in FIG. 7A to a second position in FIG. 7B. As shown, tray assembly 400 is positioned in a first tray position, with the primary restraint 370 positioned proximate the back edge of the arcuate passage 448 of the secondary restraint 440 (i.e., the edge closer to the seat back 320). The latches 430 may then be engaged (as explained above) to release the tray assembly 400. A force is applied to the tray assembly (indicated by arrow F1) to move the assembly along the armrests 340. As the tray assembly 400 moves, the gap between the primary restraint 370 and the secondary restraint 440 remains generally constant, permitting the secondary restraint 440 to travel over the primary restraint 370. The tray assembly 400 can be moved until the second tray position is achieved. For example, as shown in FIG. 7B, in the second tray position, the primary restraint 370 is now positioned proximate the front edge of the arcuate passage 448 of the secondary restraint 440. With this configuration, the clearance between the tray assembly 400 and the seat back 320 may be adjusted to accommodate children of various sizes, while effectively providing a safety mechanism that prevents a child from sliding out from under the tray regardless of the distance the tray assembly 400 is positioned away from the seat back 320.

Figure 8:
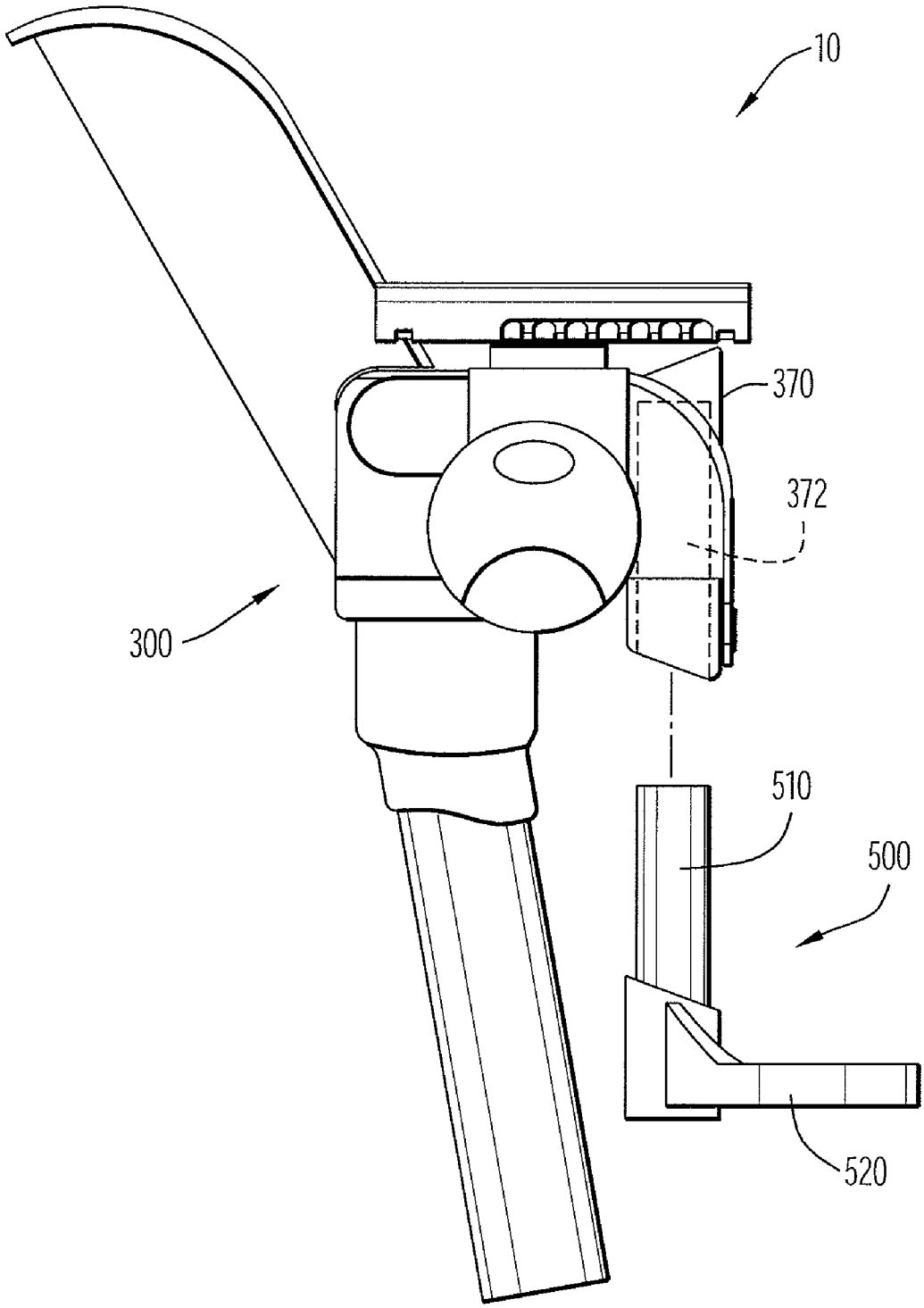
FIG. 8 illustrates a side, close-up view of the child support shown in FIG. 1, showing the relationship between the footrest assembly and the primary restraint.

The high chair 10 may further include a footrest assembly 500 adapted to adjust and accommodate children of various sizes. Referring to FIG. 8, the footrest assembly 500 includes a support member 510 and a footrest member or platform 520. The support member 510 may comprise a rod having substantially cylindrical body contoured for compatibility with the internal channel 372 of the primary restraint 370. The support member 510, however, may be any size and shape suitable for its described function. The support member 510 couples to the primary restraint 370 at its upper end and to the platform 520 at its lower end. The support member 510 is adapted to slidably engage the channel 372 of the primary restraint 370 and, as such, can be moved axially into and out of the channel 372. With this configuration, the height of the platform 520 (i.e., the distance the platform is portioned from the bottom of the seat base 310) can be adjusted from a first footrest position to a second footrest position, and vice versa.

Figure 9C:
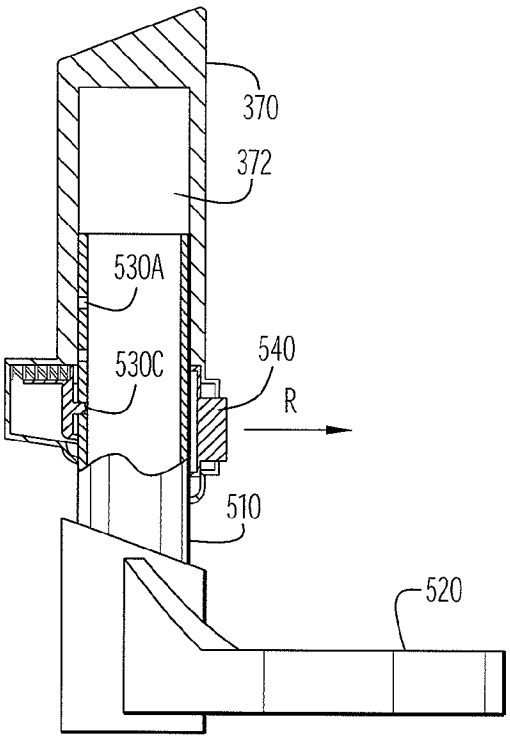
FIGS. 9A-9C illustrate cross sectional views of the primary restraint and the footrest illustrating how the footrest is moved from a first position in FIG. 9A to a second position in FIG. 9C.
Figure 9B:
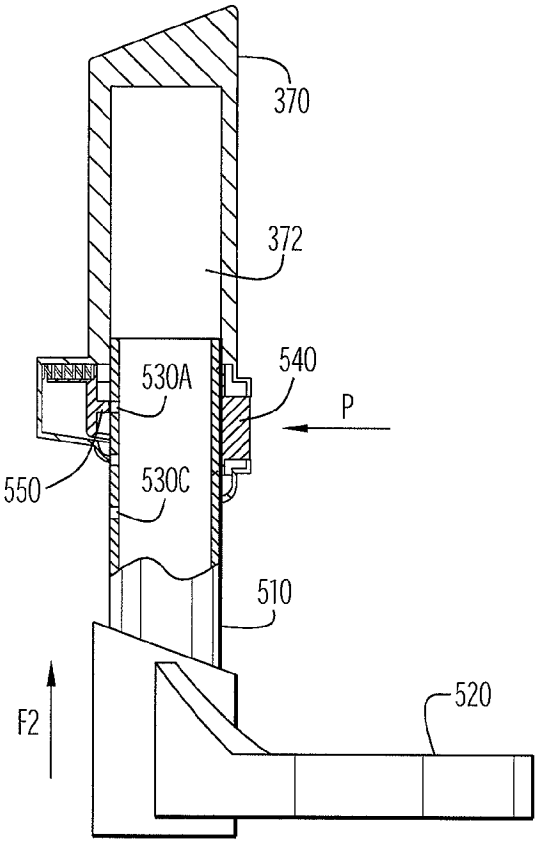
Figure 9A:
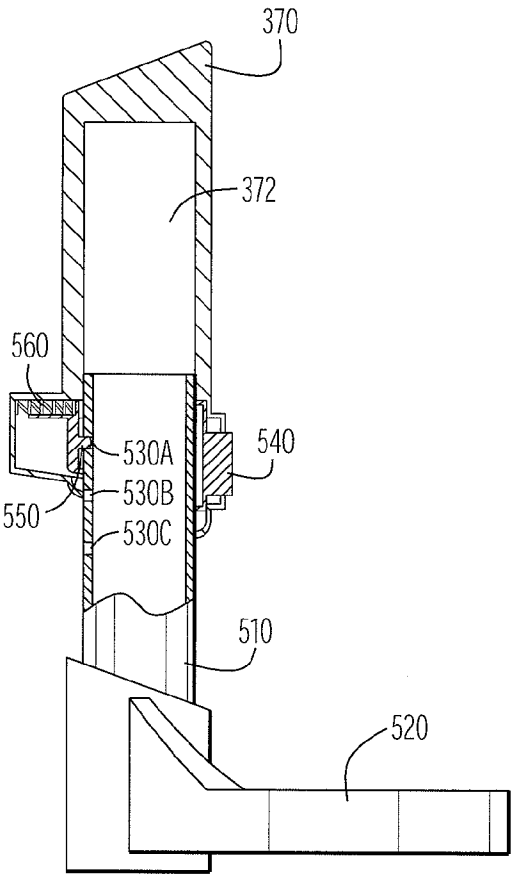

The primary restraint 370 may further include a locking mechanism to secure the platform 520 at a desired height. Referring to FIGS. 9A-9C, support member 510 may include a series of vertically aligned notches or slots 530A, 530B, and 530C (collectively 530). The base of the primary restraint 370, moreover, may include an actuator or button 540 coupled to a tab 550 having dimensions sufficient to be received by each of the notches 530. The button 540 may be spring biased outward (via spring 560). When the button 540 is in its biased (normal) position, the tab 550 extends into the channel of the primary restraint such that, when aligned appropriately, the tab is received in one of the notches 530. Each notch 530 includes dimensions sufficient to secure the tab 550 therein; consequently, when the tab 550 is positioned within a notch 530, the axial movement of the support member 510 within the channel 372 of the primary restraint 370 is prevented. This, in turn, secures the platform 520 at a desired height. When the button 540 is depressed, the tab 550 is drawn out of the notch, permitting the axial movement of the support member 510 within the primary restraint channel 372.

In operation, a user engages (e.g., depresses) the button 540 (as illustrated by arrow P in FIG. 9B), moving the tab 550 from its normal, biased position in which it is positioned within a first notch 530A, to a retracted position, in which the tab is removed from the first notch 530A. Once removed from the first notch, 530A, the user is free to move the support member 510 within the channel 372 of the primary restraint 370. Specifically, a user may axially insert the support member 510 further into (to decrease the distance between the platform 520 and the seat 300) or remove the support member 510 out of (to increase the distance the platform 520 is positioned with respect to the seat 300) the primary restraint channel 372 until the desired height is achieved. The button 540 is then released-the spring urges the tab 550 toward the support member 510 (see arrow R in FIG. 9C) and, when aligned, into a second notch 530C. The tab 550 is received by the second notch 530C, securing the platform 520 at the new height. In this manner, the height of the footrest assembly 500 (with respect to the seat 300) may be selectively adjusted.

While the invention has been described in detail and with reference to specific embodiments thereof, it will be apparent to one skilled in the art that various changes and modifications can be made therein without departing from the spirit and scope thereof. For example, the support device 10 can be of any size and shape, and may include additional accessories such as a toy bar. The material used to manufacture the high chair 10 may include, but is not limited to one or more of metal, plastic, wood, etc. The base 100 and frame 200 can be any structure operable to support the seat 300 above a supporting surface 5. For example, instead of a pedestal, the base 100 and frame 200 may comprise a series of four legs that support the seat 300 above a supporting surface 5. The legs may further be adapted to fold for storage. The seat 300 may comprise any structure suitable to support a child including, but not limited to a high chair, an infant swing, a booster seat, and/or a stroller. The primary restraint 370 may be formed as an integral part of the seat base, or may be removably connected thereto. Thus, it is intended that the present invention covers the modifications and variations of this invention that come within the scope of the appended claims and their equivalents.

Thus, it is intended that the present invention cover the modifications and variations of this invention that come within the scope of the appended claims and their equivalents. For example, it is to be understood that terms such as "left", "right" "top", "bottom", "front", "rear", "side", "height", "length", "width", "upper", "lower", "interior", "exterior", "inner", "outer" and the like as may be used herein, merely describe points of reference and do not limit the present invention to any particular orientation or configuration.

I claim:

1. A child support device comprising:

a seat portion operable to support a child;

a primary restraint mounted on the seat portion configured to restrain a child supported within the seat portion; and a tray assembly including:

a tray, and a secondary restraint adapted to receive the primary restraint, the secondary restraint extending downwardly from the tray toward the primary restraint, wherein the secondary restraint is oriented in spaced relation from the primary restraint such that a gap exists between the primary and secondary restraints, the gap permitting the movement of the secondary restraint over the primary restraint without interference from or contact with the primary restraint, wherein the tray assembly is adapted to move from first tray position to a second tray position and the primary and secondary restraints cooperate to restrain a child supported within the seat portion in each of the first and second positions.

2. The child supporting device of claim 1, wherein the primary restraint comprises a crotch post.

3. The child support device of claim 2, wherein the secondary restraint comprises:

a first extension portion, a second extension portion, and an intermediate portion oriented between the first and second extension portions, the intermediate portion comprising a generally arcuate passage that defines an open channel configured to receive the primary restraint.

4. The child support device of claim 3, wherein the primary restraint remains positioned within the channel as the tray assembly moves from the first tray position to the second tray position.

5. The child support device of claim 1, wherein the secondary restraint comprises an open channel configured to receive the primary restraint and to permit movement of the tray assembly from the first tray position to the second tray without interference from or contact with the primary restraint.

6. The child support device of claim 5, wherein the primary restraint remains positioned within the channel as the tray assembly moves from the first tray position to the second tray position.

7. The child support device of claim 1, wherein the child support device is selected from the group consisting of a high chair, an infant swing, a booster seat, and a stroller.

8. The child support device of claim 1, wherein:

the seat portion includes:

a child receiving side and an outer side opposite the child receiving side, a seat base and a seat back, and the primary restraint extends from the child receiving side of the seat base; an the tray assembly includes a first surface and a second surface, the second surface disposed facing the child receiving side of the seat base; and the secondary restraint extends from the second surface of the tray assembly, the secondary restraint comprising an open channel that receives a portion of the primary restraint.

9. A child support device comprising:

a seat portion including a primary restraint to restrain a child supported within the seat portion, wherein the primary restraint comprises a post including a channel; and a footrest portion adjustably coupled to the primary restraint and configured to support the feet of a child positioned within the seat portion, wherein the footrest portion comprises a footrest member supported by a support member, wherein the channel of the primary restraint is configured to slidably receive the support member such that the footrest portion is capable of being moved from a first footrest position to a second footrest position, and vice versa.

10. The child support device of claim 9, wherein the footrest portion is adapted to move vertically with respect to the seat portion.

11. The child receiving device of claim 9, wherein the footrest portion moves from the first footrest position to the second footrest position by axially inserting the support member into or out of the channel.

12. The child receiving device of claim 9, wherein the child support device is selected from the group consisting of a high chair, an infant swing, a booster seat, and a stroller.

13. A method of adjusting a child support device comprising:

(a) providing a child support device including:

a seat portion operable to support a child;

a primary restraint mounted on the seat portion configured to restrain a child supported within the seat portion; and a tray assembly including a tray and a secondary restraint configured to receive the primary restraint, the secondary restraint extending downwardly from the tray toward the primary restraint, wherein the secondary restraint is oriented in spaced relation from the primary restraint such that a gap exists between the primary and secondary restraints, the gap permitting the movement of the secondary restraint over the primary restraint without interference from or contact with the primary restraint; and (b) moving the tray assembly with respect to the seat from a first tray position to a second tray position, wherein the primary and secondary restraints cooperate to restrain a child supported within the seat portion in each of the first and second positions.

14. The method of adjusting a child supporting device of claim 13, wherein:

the primary restraint comprises a crotch post;

the secondary restraint comprises:

a first extension portion, a second extension portion, and an intermediate portion oriented between the first and second extension portions, the intermediate portion comprising a generally arcuate passage that defines an open channel configured to receive the primary restraint; and (b) comprises (b. 1) driving the tray assembly such that the secondary restraint moves over the crotch post.

15. The method of adjusting a child support device of claim 13, wherein:

the secondary restraint defines an open channel that receives at least a portion of the primary restraint; and the open channel permits movement of the tray assembly from the first tray position to the second tray position without interference from or contact with the primary restraint.

16. The method of adjusting a child support device of claim 15, wherein the primary restraint remains positioned within the channel as the tray assembly is moved from the first tray position to the second tray position.

17. The method of claim 13 wherein:

the seat portion includes:

a child receiving side and an outer side opposite the child receiving side, a seat base and a seat back, and the primary restraint extends from the child receiving side of the seat base;

the child support device comprises footrest portion including a footrest member supported by a support member; and the primary restraint defines a channel operable to at least partially receive the footrest support member, the method further comprising (c) moving the footrest portion with respect to the primary restraint from a first footrest position to a second footrest position.

18. The method of adjusting a child support device of claim 13, wherein the child support device is selected from the group consisting of a high chair, an infant swing, a booster seat, and a stroller.

19. A child support device comprising:

a seat portion including:

a child receiving side and an outer side opposite the child receiving side, and a seat base and a seat back;

a primary restraint extending from the child receiving side of the seat portion, the primary restraint configured to restrain a child supported within the seat portion; and a footrest portion comprising a footrest member supported by a support member, wherein the footrest portion is adjustably coupled to the primary restraint and configured to support the feet of a child positioned within the seat portion, wherein the primary restraint defines a channel operable to at least partially receive the footrest support member.

* * * * *